US009194185B2

(12) United States Patent
Göcke et al.

(10) Patent No.: US 9,194,185 B2
(45) Date of Patent: Nov. 24, 2015

(54) GUIDING DEVICE FOR A DRILLING DEVICE

(75) Inventors: Frank Göcke, Lennestadt-Bilstein (DE); Joachim Schmidt, Lennestadt-Bilstein (DE); Elmar Koch, Eslohe (DE); Sebastian Fischer, Lennestadt (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 590 days.

(21) Appl. No.: 13/380,569

(22) PCT Filed: Apr. 15, 2010

(86) PCT No.: PCT/EP2010/002318

§ 371 (c)(1),
(2), (4) Date: Mar. 15, 2012

(87) PCT Pub. No.: WO2010/149238

PCT Pub. Date: Dec. 29, 2010

(65) Prior Publication Data

US 2012/0168230 A1 Jul. 5, 2012

(30) Foreign Application Priority Data

Jun. 26, 2009 (DE) ..... 10 2009 030 865

(51) Int. Cl.
*E21B 7/06* (2006.01)
*E21B 7/04* (2006.01)

(52) U.S. Cl.
CPC ..... *E21B 7/062* (2013.01); *E21B 7/046* (2013.01); *E21B 7/067* (2013.01)

(58) Field of Classification Search
CPC ..... E21B 7/00; E21B 7/08; E21B 7/04; E21B 15/04
USPC ..... 175/74, 75, 61, 73, 173, 250.01
See application file for complete search history.

(56) References Cited

U.S. PATENT DOCUMENTS

| | | | | | |
|---|---|---|---|---|---|
| 2,018,007 | A * | 10/1935 | Brewster | 175/75 |
| 2,327,693 | A * | 8/1943 | Armentrout | 175/75 |
| 4,732,223 | A * | 3/1988 | Schoeffler | 175/73 |
| 5,070,950 | A * | 12/1991 | Cendre et al. | 175/74 |
| 5,265,684 | A * | 11/1993 | Rosenhauch | 175/61 |
| 5,547,031 | A * | 8/1996 | Warren et al. | 175/61 |
| 5,875,859 | A | 3/1999 | Ikeda et al. | |
| 6,059,661 | A | 5/2000 | Simpson | |
| 6,082,470 | A | 7/2000 | Webb et al. | |
| 6,550,548 | B2 * | 4/2003 | Taylor | 175/45 |
| 2002/0185314 | A1 | 12/2002 | Cargill et al. | |
| 2004/0188142 | A1 | 9/2004 | Self et al. | |
| 2004/0194951 | A1 | 10/2004 | Maxwell et al. | |
| 2004/0231893 | A1 * | 11/2004 | Kent | 175/74 |

FOREIGN PATENT DOCUMENTS

| | | |
|---|---|---|
| EP | 1 086 291 B1 | 3/2001 |
| WO | WO 2007/143773 A1 | 12/2007 |

* cited by examiner

*Primary Examiner* — Kenneth L Thompson
*Assistant Examiner* — Steven MacDonald
(74) *Attorney, Agent, or Firm* — Howard IP Law Group, PC

(57) ABSTRACT

The invention relates to a guide device for a drilling device, comprising a housing having deflection means for generating a side force, and a shaft rotatably supported within the housing, wherein the shaft comprises connection means at a first end for connecting to a drilling rod, and connection means at a second end for connecting to a drilling head, and wherein coupling means are provided for connecting the shaft to the housing in a rotationally fixed manner as needed.

20 Claims, 17 Drawing Sheets

GUIDING DEVICE FOR A DRILLING DEVICE

CROSS-REFERENCES TO RELATED APPLICATIONS

This application is the U.S. National Stage of International Application No. PCT/EP2010/002318, filed Apr. 15, 2010, which designated the United States and has been published as International Publication No. WO 2010/149238 and which claims the priority of German Patent Application, Serial No. 10 2009 030 865.2, filed Jun. 26, 2009, pursuant to 35 U.S.C. 119(a)-(d).

BACKGROUND OF THE INVENTION

The invention relates to a guiding device for a drilling device as well as to a drilling device having such a guiding device From the state of the art drilling devices are known, with which a change of drilling direction during the drilling of the borehole is possible.

For example from the field of horizontal drilling technology, drilling devices are known, in which a drill head, which is connected via a drill rod to a drive unit located above ground, is propelled statically and/or dynamically into the soil by the drive unit. A steering function can be achieved in such drilling devices by providing the drill head with an asymmetrically slanted face surface to cause a lateral force to act on the drill head when being advanced through the soil, leading to a deviation of the drill head from the straight drilling direction. Advancing such a slanted drill head only statically or dynamically without rotating leads to an arched course of the drill inside the soil. Such a drilling device enables a straight drilling by advancing the slanted drill head not only under pressure but at the same time driven rotatingly so that lateral forces which cause a deviation are compensated over the course of a complete revolution of the slanted drill head and on average a straight drilling course results.

Such Drilling devices are suited well for a drilling in soils, which can be easily deformed because the drilling effect is essentially based on a radial displacement and compaction of the soil. Such drilling devices are, however, inadequate for use in a harder soil and in rock formation, because here it is necessary to first break down and then remove the rock from the borehole.

Essentially, two different designs of drilling devices exist, which are suitable for drilling in harder soil as well as in rock formation.

Drilling devices according to a first of these designs are based on an in-hole motor, i.e. a motor which is arranged in the region of the drill head of a drilling device and, together with the drill head, is propelled through the soil. The in-hole motor acts directly on and rotatingly drives the drill head. The pressure forces necessary for the propulsion of the drill head are transferred to the drill unit, comprised of the in-hole motor and the drill head, via a drill rod by a drive unit which is located above ground. So-called "mud-motors" are normally used as in-hole motors. These involve motors which operate according to the "Moineau"-principle or are based on turbines and driven hydraulically. The mud-motors are typically driven by a drilling fluid which is fed to the mud-motors under high pressure through the hollow drill rod or other feed pipe, after which the drilling fluid is discharged via respective outlet openings in the region of the drill head, to lubricate and cool the front of the drill head and to flush out the removed soil or rocks from the borehole.

A steering ability in this type of drilling devices can be achieved in that the housing of the in-hole motor, which is preferably located as close as possible to the drill head or a section of the rod assembly, is provided with deflection means, which generate a lateral force causing a respective deviation from the straight drilling course.

From the state of the art, it is known to use a so called deflection shoe as deflection means, which deflection shoe is fastened to one side of the housing of the in-hole motor or a section of the drill rod and thus causes the lateral deflection. As an alternative, the same effect can be achieved by forming the housing of the in-hole motor or a section of the drill rod asymmetrically. A third known possibility is to provide the housing of the in-hole motor or a section of the drill rod with a curvature or an angled course to achieve the desired deflection. Further, it is known to connect the drill head itself to a driveshaft of the in-hole motor such that the rotation axis of the drill head is not coaxial to the longitudinal axis of the in-hole motor and the section of the drill rod which is connected to it. A straight drilling course is achieved with these drilling devices by rotatingly driving the housing of the in-hole motor which comprises the deflection means and the rod assembly so that the lateral force action of the deflection means is compensated over the course of a complete revolution. For changing the drilling direction, the rotation of the housing and the drill rod is interrupted however until the desired drilling direction is achieved.

These drilling devices have the disadvantage that they require large amounts of drilling fluid under high pressure for driving the mud-motors, and therefore require the provision of large and expensive pumps. Also, a sufficiently great cross section has to be provided inside of the drill rod through which the drilling fluid can be transported to the mud-motor by a pump located at the surface, to prevent the flow resistances inside the drill rod from causing excessive pressure loss. With regard to the forces and torques that have to be transferred, the drill rod therefore has to be "overdimensioned". A further problem is that the disposal of the spent drilling fluid is elaborate and therefore expensive. Because significantly more drilling fluid is required for driving the mud-motors than would be needed for cooling, lubricating and flushing out the drillings, the cost of disposal of the drilling fluid also rises.

These drawbacks of drilling devices based on in-hole motors for hard soil and rock formation have led to the development of drilling devices that are independent of such an in-hole motor, but are still suitable for a drilling in hard soil or rock formation. These drilling devices are based on a double drill rod which includes an outer tube having a front end which faces the drilling ground and is normally provided with a ring-shaped annular bit, and an inner rod assembly which is rotatably supported inside the outer tube and has a front end on which the actual drill head is disposed. The double drill rod is advanced rotatingly as well as under pressure by a drive unit which is located above ground. Normally, the outer tube and the inner rod assembly are advanced in synchronism, while rotatingly driving the outer tube and the inner rod assembly independent of each other. The inner rod assembly is here driven with a rotational speed which is configured to achieve a most optimal removal of soil or rock. The outer tube which because of its direct contact with the inner wall of the already created borehole is subjected to significant friction with the inner wall is normally driven with lower rotational speeds to keep friction losses and resulting wear as low as possible.

The rotation of the outer tube rather has merely the purpose to achieve the desired steering function of the drilling device. For this, similar to the drilling devices with in-hole motor, the outer tube of the double rod assembly is provided with deflection means in the region of the drill head to generate a lateral force, causing an arched drilling course when a non-rotating outer tube is involved. For a straight drilling, the outer tube is rotated continuously according to the same principle as in the afore-mentioned alternative drilling devices so that on average a straight drilling course is established. The rotational speed of the outer tube which for this purpose rotates continuously can be significantly lower than a rotational speed that is appropriate for the inner rod assembly which carries the drill head. The major disadvantage of such devices with double drill rod is the elaborate and therefore expensive construction of the double drill rod itself.

Against the background of this state of the art, the invention was based on the object to provide a drilling device which is simple in structure and makes it possible to introduce boreholes in hard soil or rock formation.

SUMMARY OF THE INVENTION

This object is solved by a drilling device and a guiding device according to the invention. Advantageous embodiments of this guiding device are the subject matter of the dependent patent claims and explained by the following description of the invention.

A drilling device according to the invention includes a drill rod, a drill head preferably configured for drilling in hard soil or rock as amply known from the state of the art, and a guiding device according to the invention, which is arranged between the drill rod and the drill head and constructed to create the lateral deflection necessary for a steering ability of the drilling device.

A guiding device according to the invention includes a housing which has deflection means for generating lateral forces to cause the deflection, and a shaft rotatably supported in the housing, wherein the shaft has connection means on a first end for the connection to the drill rod and connection means on a second end for the connection to the drill head. Further, the guiding device has coupling means to allow implementation of a fixed rotative connection of the shaft to the housing.

The guiding device according to the invention allows to drive the drill head directly via a (preferably simple) drill rod, eliminating the need for an in-hole motor as well as for an elaborate double drill rod. The desired steering ability of the drilling device is achieved according to the invention by optionally connecting the housing of the guiding device, which includes the deflection means, to the shaft of the guiding device in a fixed rotative manner so that through controlled rotation of the housing with the shaft the deflecting action caused by the deflection means can be neutralized to achieve a straight drilling. Otherwise, the fixed rotative connection can be released when a change in direction of the drill device is desired so that the housing which no longer rotates causes the desired deflection action.

Preferably, the coupling means can be operated hydraulically, to create or release the optional fixed rotative connection of the shaft with the housing. Advantageously, for the hydraulic operation, a drill fluid can be used which is fed into the drilling device to be released in particular in the region of the drill head, to—as is known—lubricate the drill head and to flush out the soil/rock that has been removed from the drillings.

Alternatively, it is of course possible to operate the coupling pneumatically in particular by means of compressed air.

Advantageously, the coupling means can be operated in opposition to a spring force of (at least) one spring element, by which, on one hand, a secure return into a starting position can be achieved, and on the other hand—in an appropriate configuration especially of the spring element and in particular in case of a hydraulic operation—the operation of the coupling can be made dependent on the hydraulic pressure level. This allows for example to initiate operation of the coupling only at a pressure which is higher than the pressure which is required or provided for introducing a drilling fluid into the bottom of the borehole.

In an embodiment, which is preferred because of its simple design and little installation space requirement, the coupling means can include a coupling sleeve, which is arranged between the shaft and the housing and is shiftable in relation to the shaft and to the housing between first and second positions, wherein in the first position, the coupling sleeve is rotatable relative to the shaft and/or the housing and, in the second position, is connected to the shaft and/or the housing in a fixed rotative manner. According to the invention, it is not necessary that the coupling sleeve embraces the entire circumference of the shaft.

In an alternative embodiment, the fixed rotative connection of the shaft to the housing of the guiding device according to the invention can also be accomplished in that the shaft (or a part thereof) is shiftable axially in longitudinal direction relative to the housing or a section thereof, wherein the coupling means realize the fixed rotative connection between the shaft and the housing in one of the relative positions of this shift; for example, the coupling means can be formed by a coupling element of the shaft, which engages in a coupling element of the housing. In a second relative position of this shift, it can be provided that the coupling means can then no longer realize a fixed rotative connection between the shaft and the housing; here, the coupling element of the shaft can have been moved from the engagement with the coupling element of the housing. A switching of the coupling means by an axial shift of the shaft in longitudinal direction relative to the housing can be realized with a simple design.

Such a configuration of the coupling means further offers the possibility to control a switching of the coupling means through a change in the level of the pressure forces that are exerted on the shaft and the drill head via the drill rod. Preferably, a spring element can be provided for this purpose, which is arranged between the housing or a section thereof and the shaft, and which acts on the shaft in the direction of one of the switching positions of the coupling means. Preferably, this involves a switching position, in which a fixed rotative connection of the shaft with the housing is provided. Through the arrangement of the spring element, pressure forces can be transferred via the drill rod and the shaft to the drill head, which are sufficient to accomplish the desired drilling effect but are not high enough to deform the spring element to the extent to lead to a switching of the coupling element. Such a switching of the coupling can be established through targeted increase of the pressure forces.

Of course, by a corresponding reversal of the principle, it is also possible to compress the spring element during application of pressure forces provided for the drilling advance to the extent that a switching of the coupling means occurs, and to provide for a switchover by reducing or removing the pressure forces. The spring element then supports the switchover so that no pulling forces have to be applied to the shaft.

In a further preferred embodiment of the guiding device according to the invention, at least one support element can be provided which is extendable towards the inner wall of the borehole, and by which, if needed, the friction with the inner wall of the borehole can be increased to prevent unintended rotation of the housing inside the borehole.

Preferably, the integration of the support element into the guiding device is hereby realized by extending the support element also in the case when no fixed rotative connection of the housing with the shaft exists and the drilling device according to the invention is in the steering mode.

Preferably, the support element can also be extended hydraulically (of course a pneumatic extension is also possible) and, in particular, by means of a drilling fluid. With this, the same advantages can be achieved as in the case of hydraulic operation of the coupling means. Additionally, by adjusting the hydraulic pressure or, if a drilling fluid is used, by adjusting the amount of drilling fluid, the contact pressure level of the support element can be controlled and thereby adjusted to different circumstances.

Further, it is preferred that the support element can be extended in opposition to the force of a spring element. On the one hand, as in the case of the operation of the coupling means in opposition to the force of a spring, a secure return into a starting position of the support element can be achieved, and on the other hand—in an appropriate configuration especially of the spring element and in particular in case of a hydraulic operation—the extension of the support element can be made dependent on the hydraulic pressure level on. This in turn allows to initiate the extension of the support element only at a pressure which is higher than the pressure which is required or provided for introducing a drilling fluid into the bottom of the borehole.

When the coupling means as well as the support element are operated in opposition to the force of a spring element and preferably by means of the same fluid (in particular by means of a drilling fluid), it can be further provided to actuate the coupling means at a lower pressure than required for the extension of the support element. Since preferably, the coupling can be actuated at a lower (absolute) pressure, the housing can be rotated conjointly with the shaft, and at the same time a drilling fluid can be discharged, without the support element being extended.

Of course it is possible to conform the switching time points of the coupling means and the support element for example to different soil conditions by using different springs.

In an alternative embodiment of the guiding device according to the invention, the extension of the support element can be achieved by a shift of the shaft relative to the housing axially in longitudinal direction of the guiding device. This allows to coordinate the extension of the support elements with the switching of the coupling means, when the latter are operated, by an axial shifting in longitudinal direction. This allows that every time when the coupling elements of the coupling means are not engaged and a relative rotation between the shaft and the housing of the guiding device is possible, the support elements are extended. Accordingly, these are not extended every time the coupling elements of the coupling means are engaged, whereby the fixed rotative connection between the shaft and the housing is achieved.

A possible way to configure a support element, which is extended by a relative shift of the shaft in longitudinal direction relative to the housing, is to configure it as leaf spring which is supported on a side of the housing and on an opposite side, at least indirectly, on the shaft. Through the shift of the shaft relative to the housing the distance between both attachment points of the leaf spring is shortened so that the leaf spring, which is preferably prestressed radially to the outside in the form of an arch, is extended outwardly. Of course it is also possible to provide a respective extension of the support element by a rotational movement of the housing (or a section thereof) relative to the shaft (or a section thereof).

In a preferred refinement of this embodiment, the leaf spring can be supported between two sections of the housing, which are shiftable relative to each other axially in longitudinal direction of the guiding device. One of these two sections of the housing is then supported directly or indirectly by the shaft to achieve the desired radial extension of the leaf spring when the shaft moves relative to the housing. This embodiment has the significant advantage that the bearing to enable the relative rotation between the shaft and the housing, necessary for the function of the drilling device according to the invention, can be arranged between the shaft and the corresponding section of the housing. Compared to an embodiment, in which the leaf spring is supported directly by the bearing, this allows for a simpler design.

In a further preferred refinement of this embodiment of the guiding device according to the invention, the shaft can be formed telescopically extendible in a section which extends inside the housing. This allows the shift of a first section of the shaft, provided for a switching of the coupling means and/or extension of the section elements, by way of the telescopic ability of the shaft so that the second non-shifted section of the telescopically extendible shaft is not shifted relative to the corresponding section of the housing. As a result, the bearing of this non-shiftable section of the shaft in the corresponding section of the housing can significantly be simplified.

In a preferred embodiment of the guiding device according the invention, the support element, at least in the extended state, can (at least partly) be flushed underneath by means of a fluid and again preferably by means of a drilling fluid, to prevent unwanted build up of drillings underneath the support element which hinders a retraction of the support element. The ingress of drillings is effectively prevented, by feeding drilling fluid to the guiding device with overpressure (relative to the environment of the guiding device); this overpressure prevents ingress of the drillings.

In a further preferred embodiment, the support element is supported in a guide of the housing, wherein at least the outer edges of the support element can still be located inside of the guide in the extended state. As a result, the gap through which the drillings can reach underneath the support element can be minimized. Advantageously, a defined (small) part of the fluid, with which the support element is flushed underneath, can be discharged through this gap which in turn can prevent ingress of drillings and ensure a reliable mobility of the support element in the guide.

By choosing an appropriate cross section (with regard to the longitudinal direction of the guiding device or the drilling device, respectively) of the support element, different advantages can be achieved. In the case of an asymmetrical cross section, it can be achieved that the support element is particularly well supported in the housing in a rotating direction in connection with a slight retractability in the other rotating direction. A symmetrical cross section can be characterized by an easy retractability in both rotational directions, wherein losses in the supportability might have to be accepted.

The deflection means of the guiding device according to the invention are preferably configured by arching a section of the housing.

"Arched section" of the housing relates to a section in which the longitudinal axis of the section does not form a continuous straight line, but for example a constant arch, or two sections which are arranged at an angle to each other. Such an arched section of the housing can—in contrast to other deflection means—be manufactured easily and be low-maintenance.

Of course, it is also possible to form the deflection means in the form of a section of the housing with an asymmetric cross section or by arranging a so-called deflection shoe on the outside, wherein the asymmetric design of the housing may possibly be accompanied with increased manufacturing costs and the arrangement of a deflection shoe may be accompanied with increased maintenance.

The section of the shaft, which is arranged within the arched section of the housing, is preferably configured flexible and in particular elastic so as to be able to withstand with sufficient longevity the change in bending stress, caused by the relative rotation within the arched section of the housing, For a flexible configuration of the section of the shaft, any measures known from the state of the art can be used. This includes in particular an outer diameter which is reduced compared to other sections of the shaft and reduces the section modulus. To still be able to transfer the necessary pressure forces and torques via this section of the shaft, the reduced outer diameter can be compensated for example by a greater wall thickness. Such a section of the shaft would be elastic if a rebound effect was caused by the bending. A flexible but not elastic section can be achieved by forming an link shaft. This comprises multiple links flexibly connected to each other, such that the individual small sections cannot be moved in direction of the longitudinal axis relative to each other and cannot be rotated relative to each other (around the longitudinal axis of the link shaft), however can be pivoted relative to each other about an axis which is perpendicular to the longitudinal axis of the link shaft so that flexibility is achieved.

In a preferred embodiment of the guiding device according to the invention, at least one section of the flexible section of the shaft can be arranged in an eccentric bore of the housing. As a result, a relatively large receptacle (opening) can be created on one side of the housing to serve in particular for receiving a transmitter (for localization of the drilling device in the soil and/or for roll of the housing). The flexible section of shaft in the mounted state is preferably arranged inside the borehole such that it is arranged centrically with regard to the housing. For this purpose, the eccentric bore of the housing must have a greater diameter than the section of the flexible section of the shaft, which is arranged inside the bore. This greater diameter can then enable a mountability of the flexible section of the shaft, for example when formed as a separate component having end-side connection means and connected to rigid sections of the shaft on its front or back side. These connection means have a greater diameter than the remaining part of the flexible section so that the provision of the greater diameter of the eccentric bore enables a mounting of the flexible section in spite of connection means with a greater diameter.

In a further preferred embodiment, the connection means for the end of the guiding device on which the drill rod is located can be provided with cutting elements and/or an expansion cone to form a scraper which cleans the drilling device when being retracted. The shaft and thus the scraper can hereby be rotated by the drill rod, while the housing of the guiding device is at a standstill or at least is not coupled to the rotation of the shaft.

BRIEF DESCRIPTION OF THE DRAWING

An exemplary embodiment of the invention will now be described in greater detail with reference to the drawings.

In the drawings it is shown:

FIG. 1 a side view of a first embodiment of a guiding device according to the invention in;

DETAILED DESCRIPTION OF PREFERRED EMBODIMENTS

Figure 1:
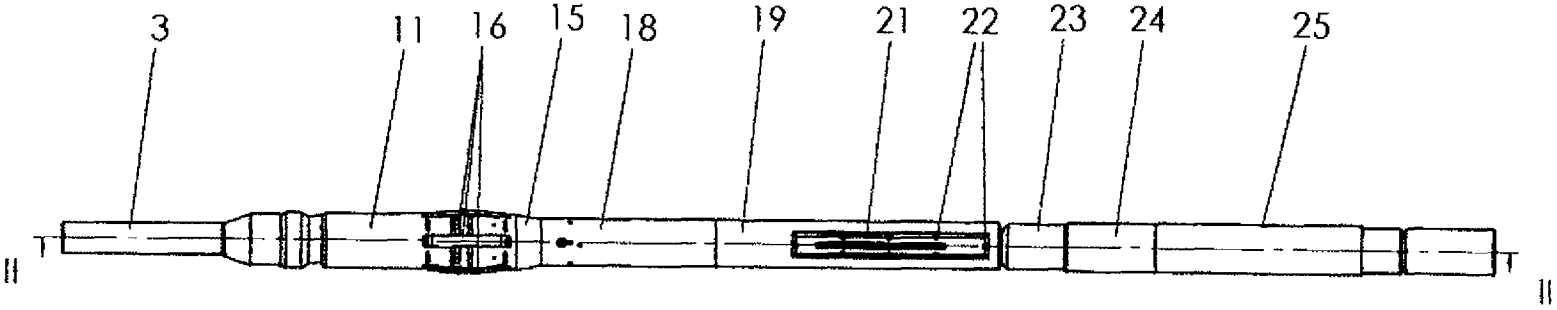
Figure 2:
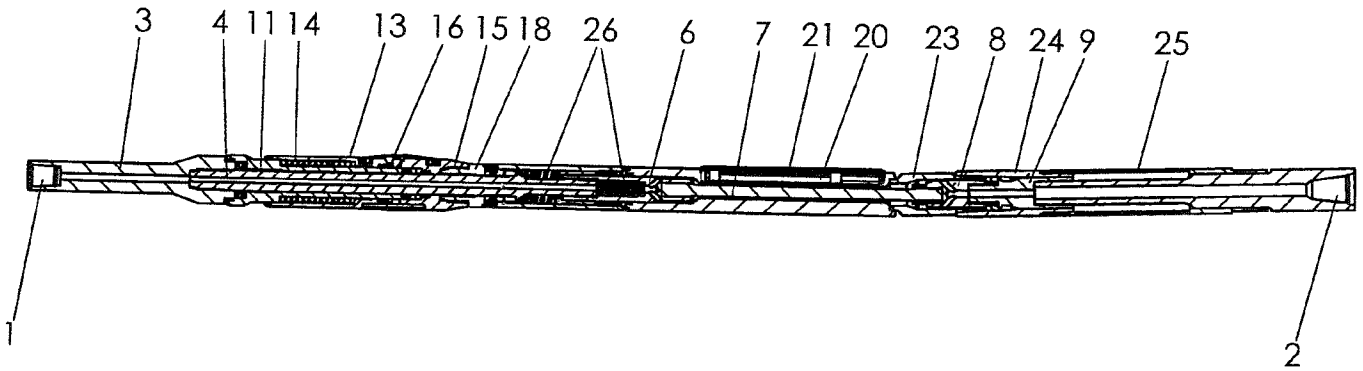
FIG. 2 a sectional side view of the guiding device of FIG. 1 along the section plane II-II.
Figure 3:
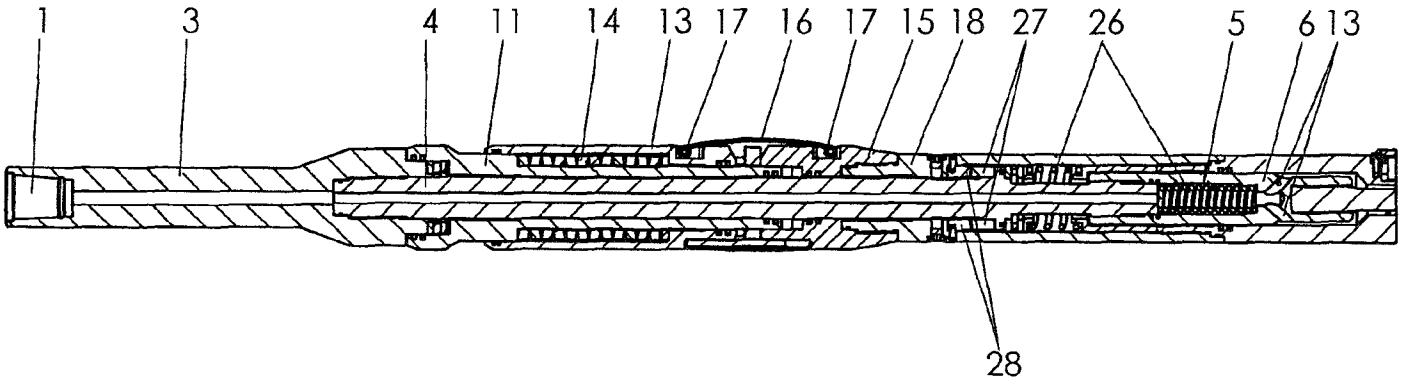
FIG. 3 an enlarged illustration of a first section of FIG. 2.
Figure 4:
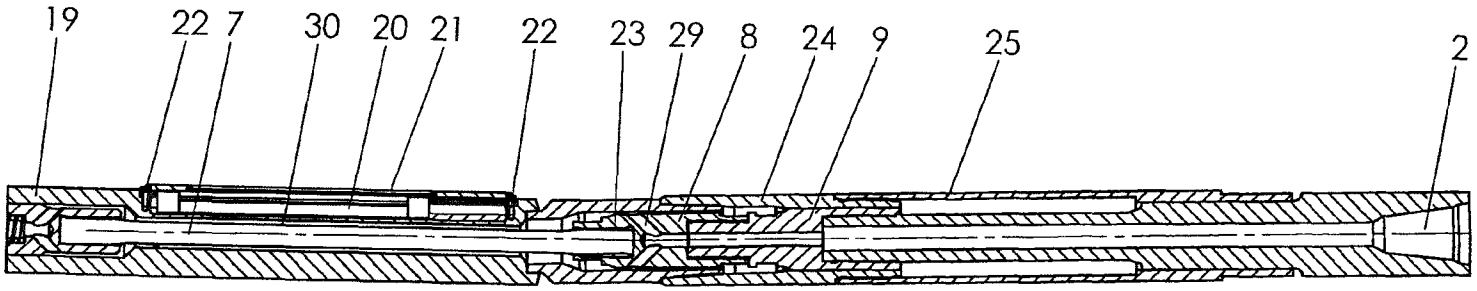
FIG. 4 an enlarged illustration of a second section of FIG. 2
Figure 5:
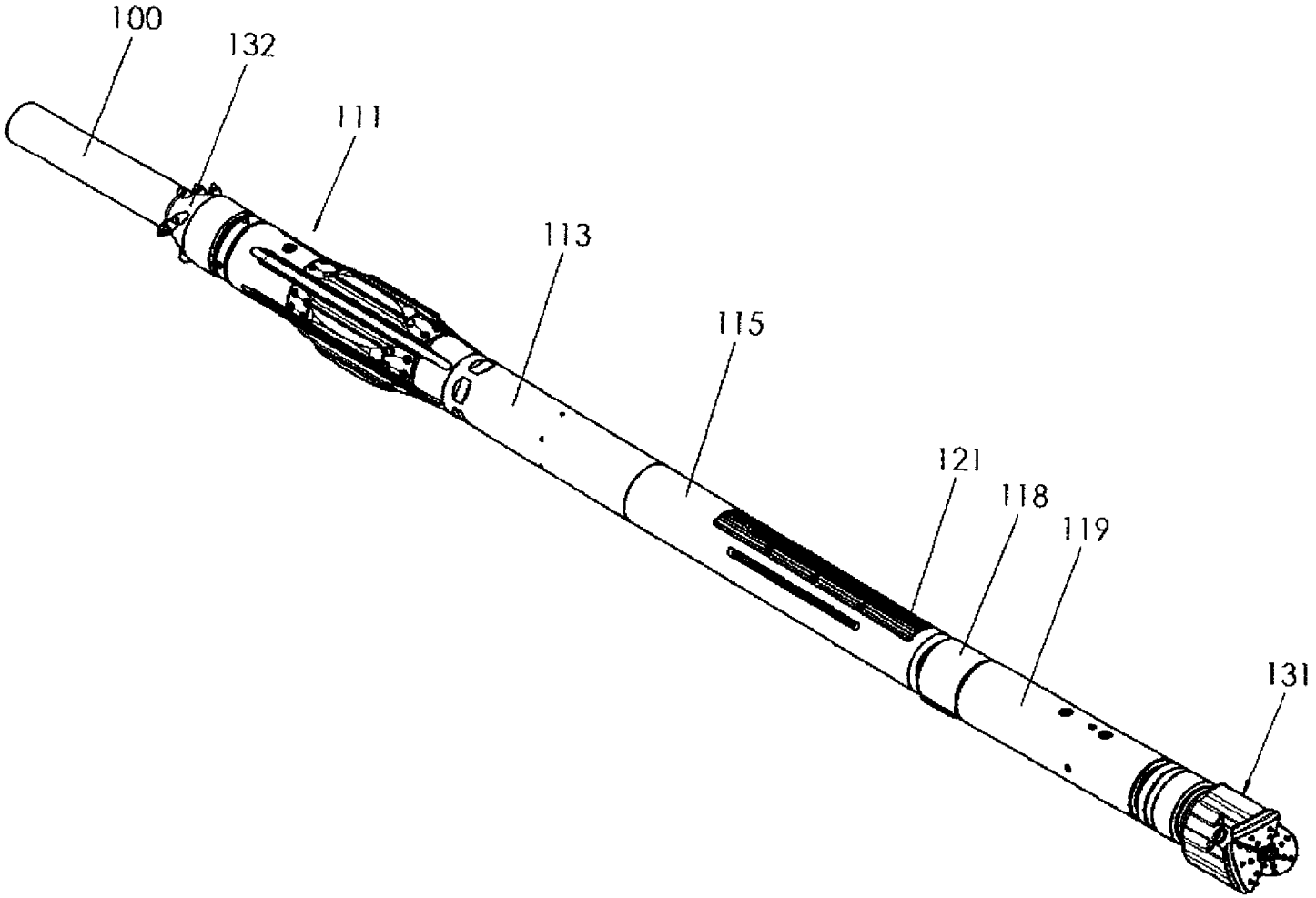
FIG. 5 a perspective view of a second embodiment of a drilling device according to the invention with a guiding device.
Figure 6:
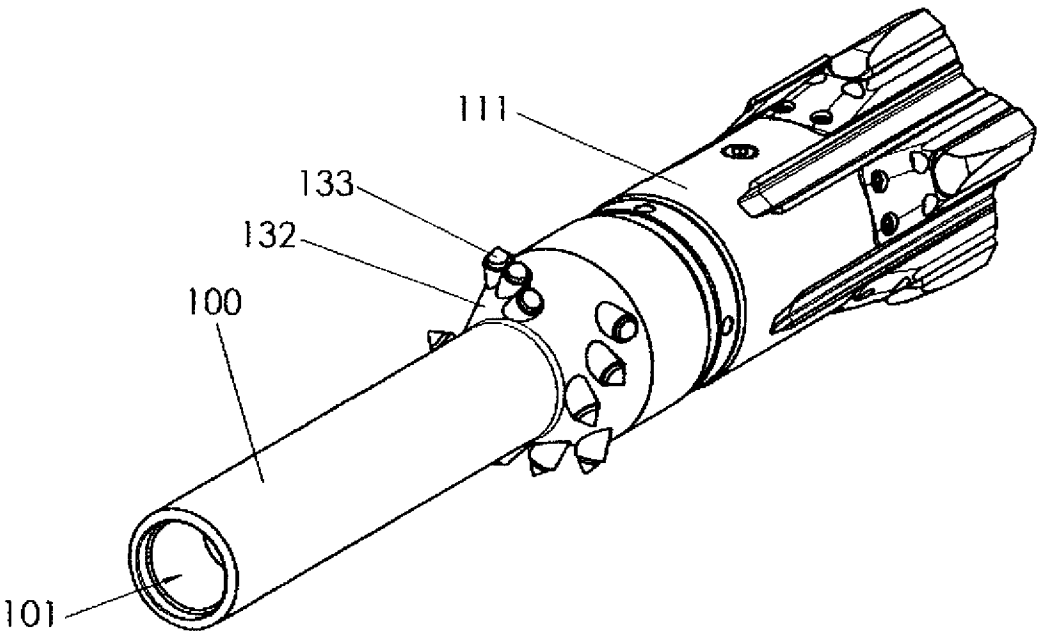
FIG. 6 a perspective view, on an enlarged scale, of a section of the shaft of the guiding device of FIG. 5.
Figure 7:
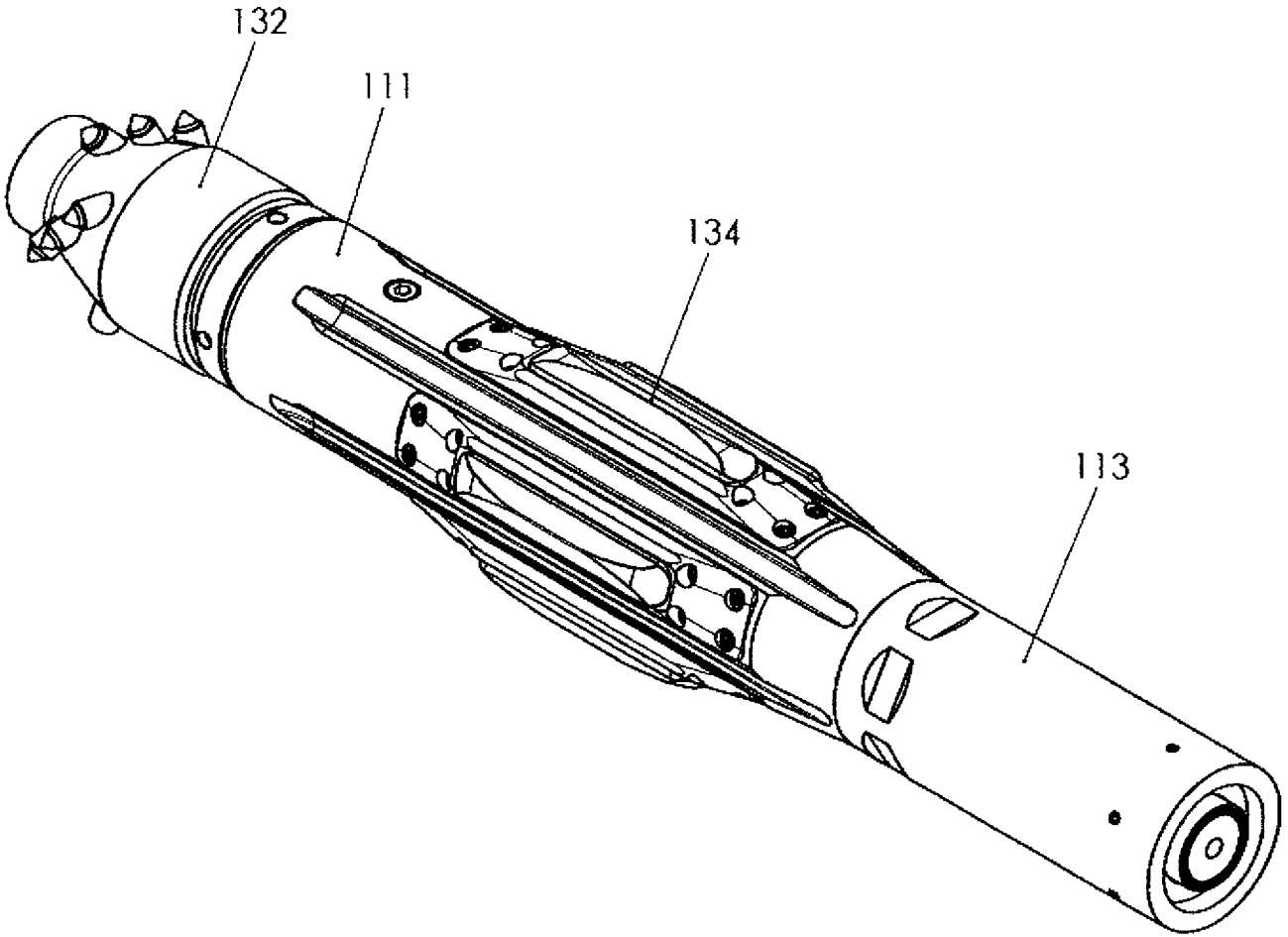
FIG. 7 a perspective view, on an enlarged scale, of a section of the housing of the guiding device of FIG. 5.

The FIGS. 1 to 4 show an embodiment of a guiding device according to the invention. The guiding device comprises a multipart housing and a shaft also multipart, rotatably supported in the housing. On its front and end sides, the shaft is provided with an internal thread 1,2 for threaded engagement of an external thread of a drill head, which is not shown (front-side) and a corresponding outer thread of a drill rod which is not shown (end-side). The shaft includes a total of seven sections, which are connected to each other by bolted connections. A first section 3 of the shaft has on one side the afore-described internal thread for connection with the drill rod and on the opposite end another internal thread for threaded engagement of an external thread of the second section 4 of the shaft. On the end opposite to the external thread, the second section 4 of the shaft is guided inside a guide bushing 5 of the third section 6 of the shaft such that it is shiftable in direction of the longitudinal axis, wherein the guide is formed such that a torque can be transferred between the second and third sections of the shaft. The third section 6 of the shaft in turn, is connected with the fourth section 7 of the shaft through a bolted connection. The same connection exists between the fourth 7 and the fifth section 8, the fifth 8 and the sixth section 9, and the sixth 9 and the seventh section 10 of the shaft.

The housing includes a total of eight sections, which are connected to each other in different ways. The first section 11 of the housing is supported by the first section 3 of the shaft via an axial bearing 12 in direction of the longitudinal axis.

The first section 11 of the housing is configured as guide bushing, on which the second section 13 of the housing is arranged shiftable in direction of the longitudinal axis. In a ring-shaped space formed by the first and second sections of the housing, a disk spring assembly 14 is located which is compressed by shifting the first section 11 and the second section 13 of the housing towards each other. The third section 15 of the housing is arranged such that the first 11 as well as the second section 13 of the housing can be moved in direction of the longitudinal axis relative to the housing.

The third 15 and the second section 13 of the housing are connected through a total of 5 leaf springs 16, which are prestressed by being arched outwards and are wrapped at their respective ends around a fastening pin 17 of the second 13 and third section 15 of the housing. In the case of a shift of the second section 13 relative to the third section 15 of the housing by way of a movement toward each other, the leaf springs 16 are deflected outwardly and thereby pushed against the borehole wall surrounding the housing.

The fourth section 18 of the housing is connected to the third section 15 via a bolted connection. A corresponding connection is provided between the fourth 18 and the fifth section 19 of the housing.

Integrated in the fifth section 19 of the housing is a depression 20 to provide the reception of a roll sensor (not shown). The purpose of the roll sensor is to detect the roll angle, which the housing assumes inside the soil. The construction and the functionality of such roll sensors are sufficiently known in the state of the art. The depression 20 for the reception of the roll sensor is closed by a lid 21 which is fixed to the housing by threaded bolts 22.

Adjoining the fifth section 19 is a sixth section 23 of the housing which is welded to the fifth section 19. The connection between the fifth 19 and the sixth section 23 is angled such that the longitudinal axis of the fifth 19 and the longitudinal axis of the sixth section 23 of the housing are not coaxial or parallel, but instead form an (small acute) angle. The fifth 19 and sixth section 23 of the housing together form an "arched section", via which a lateral force is generated, which leads to a deflection which is used for a steering of the drilling device.

The sixth 23 and the adjoining seventh section 24 of the housing are again connected by a bolted connection. The same is true for the connection between the seventh 24 and the eighth section 25 of the housing.

The mode of operation of the guiding device shown in FIGS. 1 to 4 is as follows. Via the drill rod, which is connected to the first section 3 of the shaft, and via the shaft itself, a drill head which is connected to the seventh section 24 of the shaft is driven rotatingly and acted upon by pressure forces required for a propulsion in soil or rock formation. The pressure forces transferred by the multipart shaft cause two cylindrical helical springs 26, via which the second section 4 of the shaft is supported on the third section 6 of the shaft, to become compressed, which leads to a relative movement of these two sections of the shaft toward each other. This relative movement has the effect that catches 27 arranged on the second section 4 of the shaft are disengaged from corresponding catches 28 disposed on the inside of the fourth section 18 of the housing. These catches 27, 28 of the second section 4 of the shaft or the fourth section 18 of the housing, respectively, have the purposes to transfer a rotation of the shaft to the housing, when the shaft is subject to no or only low pressure forces. As soon as the catches 27, 28 of the shaft and the housing, respectively, are disengaged, no fixed rotative connection exists between the shaft and the housing so that the shaft and the attached drill head can be driven rotatingly, without causing a corresponding rotation of the housing.

Through the movement of the first 3 and the second section 4 of the shaft relative to the other sections of the shaft or the third to eighth sections of the housing respectively, the leaf springs 16 are deflected. In opposition to the restoring forces of the disk spring assembly 14, the first section of the housing 11 which is supported in direction of the longitudinal axis by the first section 11 of the shaft is shifted in the direction of the drill head. The resultant increase of the pretension of the disk spring assembly in turn causes a shifting of the second section 13 of the housing in the direction of the drill head. This decreases the distance between the second 13 and the third section 15 of the housing, thereby radially deflecting the arched prestressed leaf springs 16 outwardly.

As described above, the drill head is driven rotatingly via the shaft of the guiding device and the drill rod and subjected to pressure which causes the cylindrical helical springs 26, which mutually support the second 4 and the third section 6 of the shaft, to be compressed to the extent, that the catches 27, 28 are no longer engaged. As a result, the rotation of the shaft is not transferred to the housing, thereby establishing propulsion of the drilling device through the soil or rock formation in an arched course. For a straight drilling, the rotation is interrupted already after a short drilling advance and the pressure application on the drill head reduced to the extent that the restoring forces of the cylindrical helical springs 26 cause the catches 27 of the second section 4 to engage the catches 28 of the fourth section 18 of the housing. Subsequently, the shaft can be rotated by a defined angle (for example 90°) by means of the drive unit which is not shown, with the housing conjointly rotated as a result of the engagement of the catches. After this, the pressure forces on the drill head are increased again so that the coupling means formed by the catches 27, 28 are disengaged. The drill head can then be advanced again for a small distance in the absence of a rotation of the housing. Thereafter, the drilling is interrupted again and the housing rotated again by 90°. This cyclical procedure is continued correspondingly. The deviations from the straight drilling course, which occur during the drilling propulsion, are compensated by the cyclical co-rotation of the housing cyclically; this result in a drilling course which is on average straight.

If a change of direction of the drilling device is intended, the housing is coupled to the rotation of the shaft by engagement of the coupling means and, with regard to its arched section, is brought into a defined position corresponding to the new drilling direction and controllable via the roll sensor. Thereafter, the coupling means are released again and the drilling device is advanced by a rotating drive of the drill head, until the desired new drilling direction is achieved.

The individual sections of the shaft, with the exception of the fourth section 7, are each provided with a central bore. These have the purpose to conduct a drilling fluid which can also be fed via a hollow drill rod, to the drill head, where it can be released into the soil through corresponding openings. The main purpose of the drilling fluid is to cool the drill head, to lubricate the contact of the drill head with the bottom of the borehole and to flush out the drillings through the ring-shaped gap between the guiding device and between the drill rod and the borehole wall, respectively. The fourth section 7 of the shaft does not have a central throughbore, but is configured as solid shaft. In this region of the guiding device, the drilling fluid is conducted through a ring-shaped gap which is formed between the fourth section 7 of the shaft and the fifth 19 and sixth section 23, respectively, of the housing. For this, the third 6 and the fifth section 8 of the shaft have multiple transverse bores 29, through which the drilling fluid can be transferred from the central bore to the ring-shaped gap 30.

The particular configuration of the fourth section 7 of the shaft has the purpose to form this section flexibly such that it can sufficiently withstand the change in bending stress caused by the arched course of the housing at the transition from the fifth 19 to the sixth section 23 of the housing and the rotation of the shaft relative to the housing. For this, the fourth section 7 of the shaft is configured with a reduced outer diameter to establish a reduced resisting torque compared to the cross sections of the other sections of the shaft.

In an alternative embodiment, not shown in the Figures, a straight drilling can be achieved by engaging the coupling means to permanently transfer the rotation of the shaft to the housing (i.e. so long as a straight drilling is desired). For changing the drilling direction, the rotation of the shaft and the coupled housing are then interrupted in the defined orientation and the coupling means disengaged. Thereafter, only the shaft and the drill head are driven rotatingly until the desired new drill direction is achieved. In contrast to the embodiments described in FIGS. 1 to 4, this alternative embodiment has the disadvantage that the engagement of the housing by the shaft during straight drilling, which requires high rotational speed of the drill head, great relative speeds exist between the housing and the borehole wall, which can lead to significant wear. Depending on the circumstances, it is possible however, to reduce the wear to a tolerable level by using a corresponding configuration and/or provision of friction-reducing additives.

FIGS. 5 to 15 show a guiding device according to the invention in a second embodiment with attached drill head. This guiding device differs in the configurations and functions described hereinafter from the afore-described first embodiment.

Again, the guiding device comprises a multipart shaft 100, which extends through an also multipart housing. The shaft 100 has an internal thread 101 on its rear end for connection to a drill rod which is not shown. The front end of the shaft 100 also has an internal thread, into which the drill head 131, which is configured as so-called roll drill head, is threadably engaged.

The rearmost section the shaft 100 has a conical expansion element 132 (compare also FIG. 6) which is additionally provided with a plurality of pin-shaped cutting elements 133. These are arranged in groups of three, wherein (with regard to the longitudinal axis of the guiding device) the three cutting elements 133 of each group are positioned behind one another in an oblique manner. Together, the conical expanding element 132 and the cutting elements 133 form a rear-side scraper for cleaning the borehole when retracting the drilling device. Because the scraper is fixed to the shaft 100, it can—together with the shaft—be rotatingly driven via the drill rod during retraction in the absence of a rotation of the housing of the guiding device.

Integrated into the first section 111 of the housing (clamping unit) adjacent to the scraper are a total of 5 support elements, which are configured as hydraulically operated clamping strips 134. FIGS. 7 to 10 show details of the clamping strips 134 as well as their integration into the guiding device.

The clamping strips 134 have an asymmetric cross section (with regard to the longitudinal axis of the guiding device), the function of which will be explained hereinafter.

Figure 8:
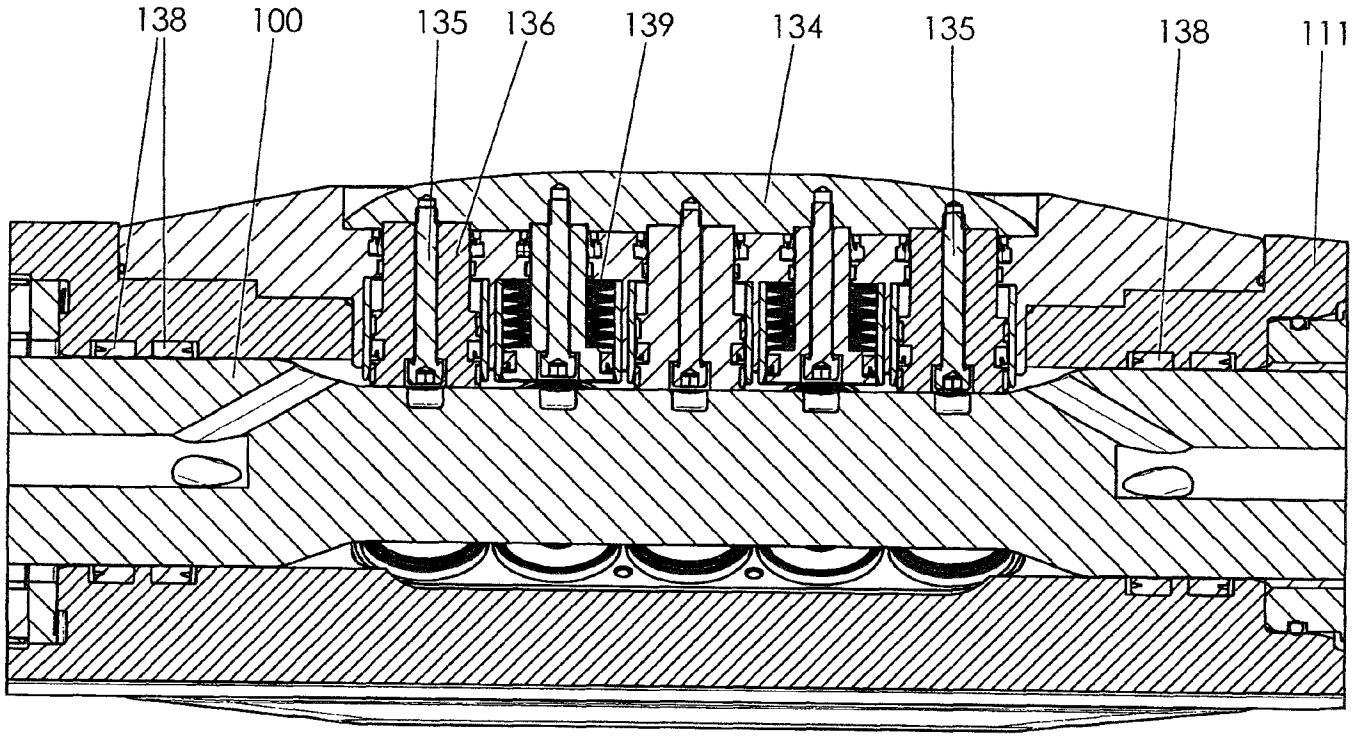
FIG. 8 a longitudinal section through the first section of the housing and the corresponding section of the shaft in a first operating position of the guiding device of FIG. 5.
Figure 9:
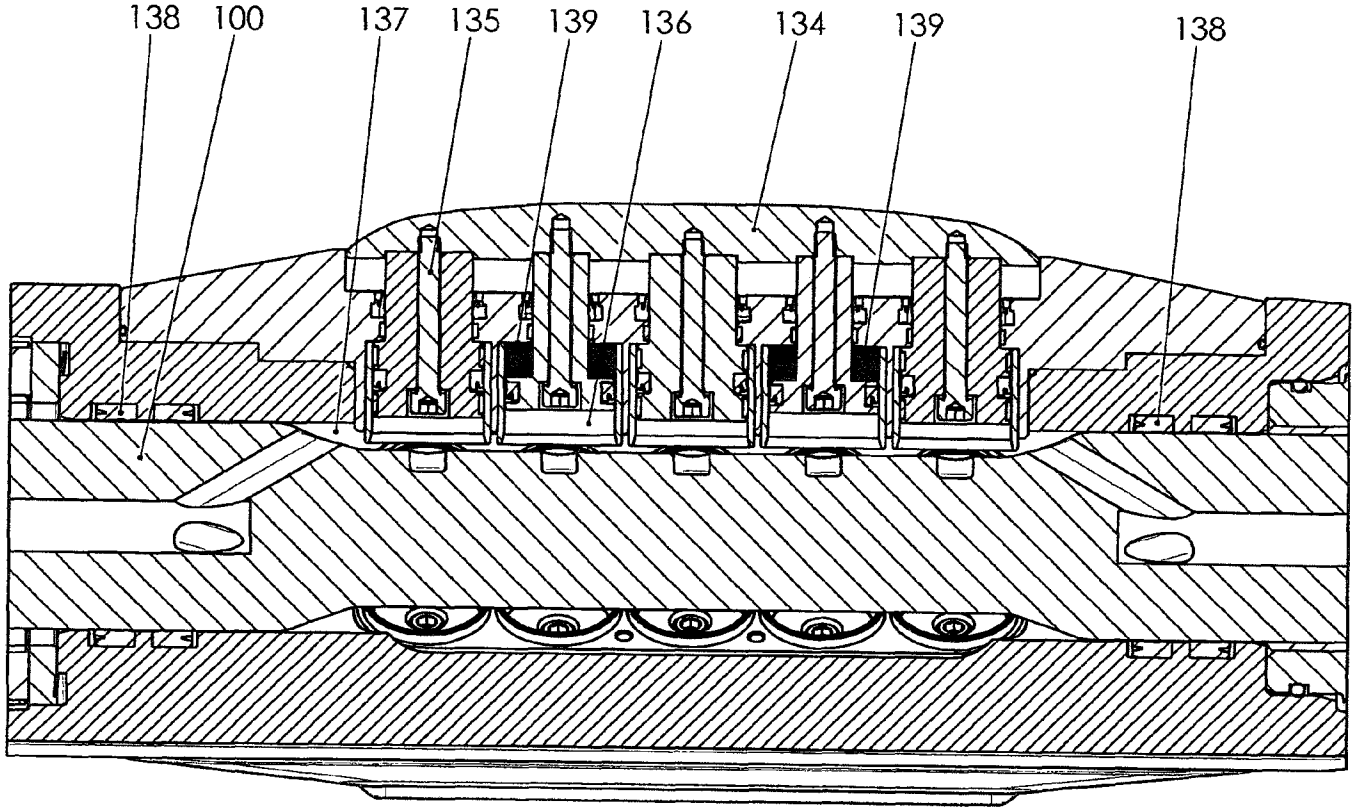
FIG. 9 a longitudinal section through the first section of the housing and the corresponding section of the shaft in a second operating position of the guiding device of FIG. 5.

Each of the clamping strips 134 is arranged in an own depression of the first housing section 111, in which they are fully retractable (compare FIG. 8). Each of the clamping strips 134 is connected via bolts 135 to a total of five pistons 136, which are movably supported in the cylinders formed in the first housing section 111. The bottom sides of the pistons 135 face towards a common (for all clamping strips 134) pressure chamber 137, through which the drilling fluid which is fed to the drilling device is conducted. The pressure chamber 137 is an interspace formed between the inside of the first housing section 111 and the corresponding section of the shaft 100. For that purpose, this section of the shaft 100 is formed with a smaller diameter. The drilling fluid is fed to the pressure chamber via an oblique branch from a central bore of the shaft 100 or drained from the pressure chamber again via a corresponding oblique branch. Sealing rings 138 on both sides of the pressure chamber 137 prevent an unintended escape of the drilling fluid. The bottom sides of the pistons 136 are thus subjected to the pressure of the drilling fluid. This pressure generates a force, which—given a sufficient level—causes the clamping strips 134 to move out to the end position shown in FIG. 9. The extension of the clamping strips 134 is hereby established in opposition to the force of two disk spring assemblies 139 (per clamping strip), the prestress of which opposes the extension movement of the clamping strip.

Figure 10:
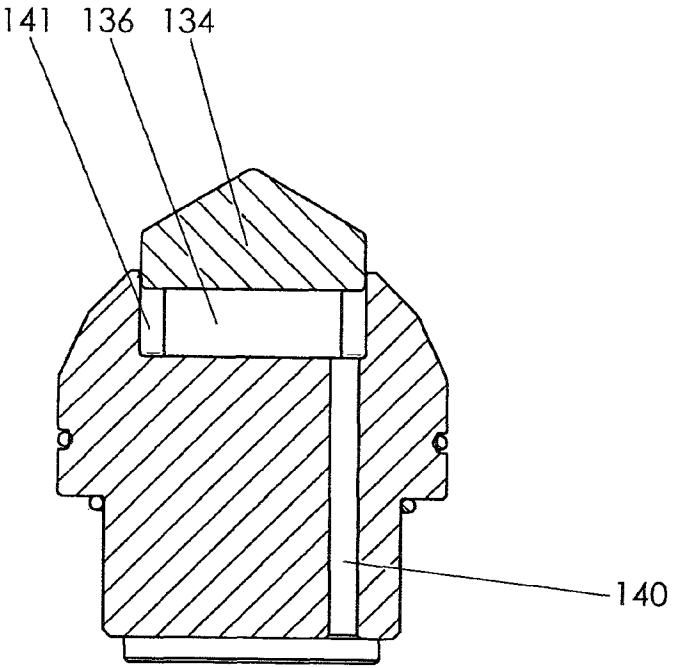
FIG. 10 a partial cross section through the first section of the housing of the guiding device of FIG. 5.
Figure 11:
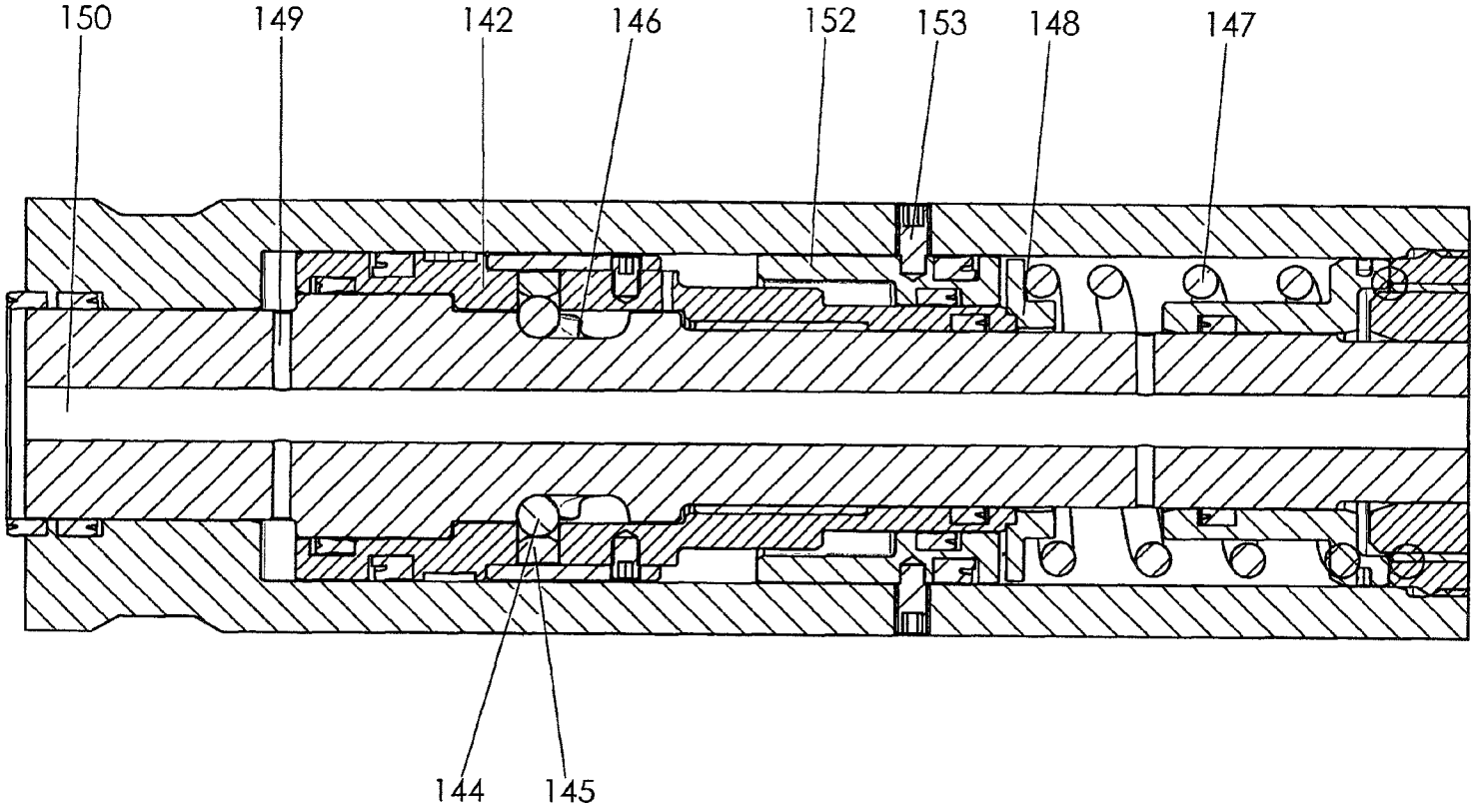
FIG. 11 a longitudinal section through a second section of the housing and the corresponding section of the shaft in a first operating position of the guiding device.
Figure 12:
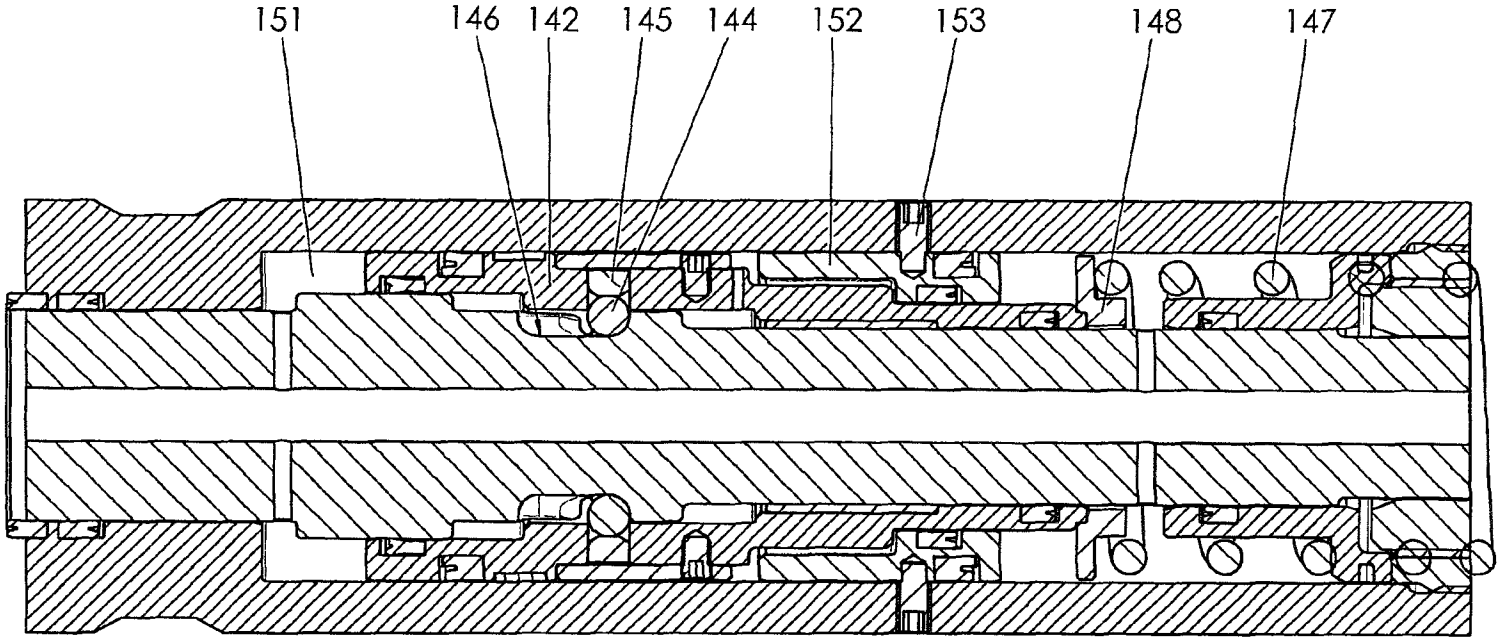
FIG. 12 a longitudinal section through the second section of the housing and the corresponding section of the shaft in a second operating position of the guiding device of FIG. 5.
Figure 13:
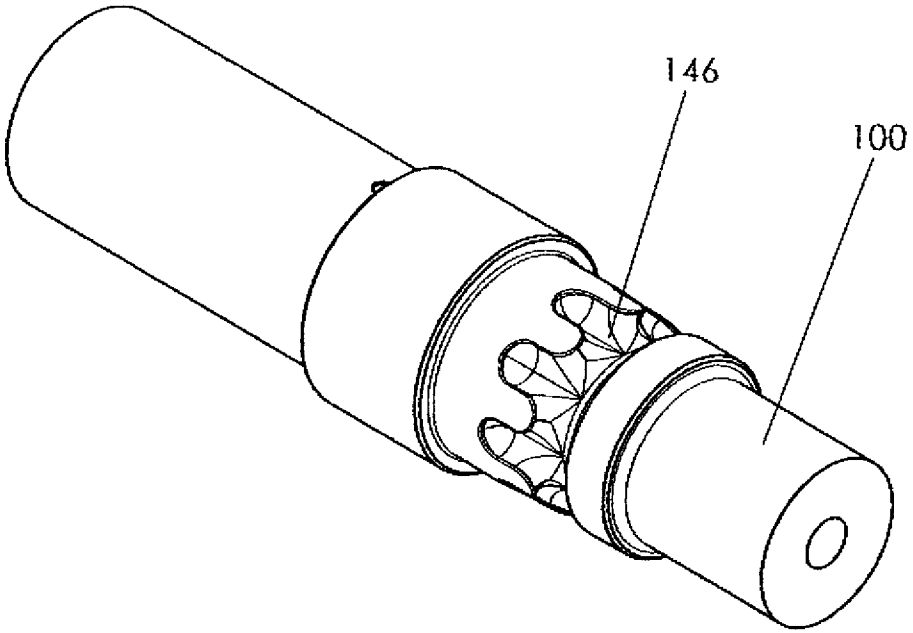
FIG. 13 a perspective view of a section of the shaft of the guiding device of FIG. 5.
Figure 14:
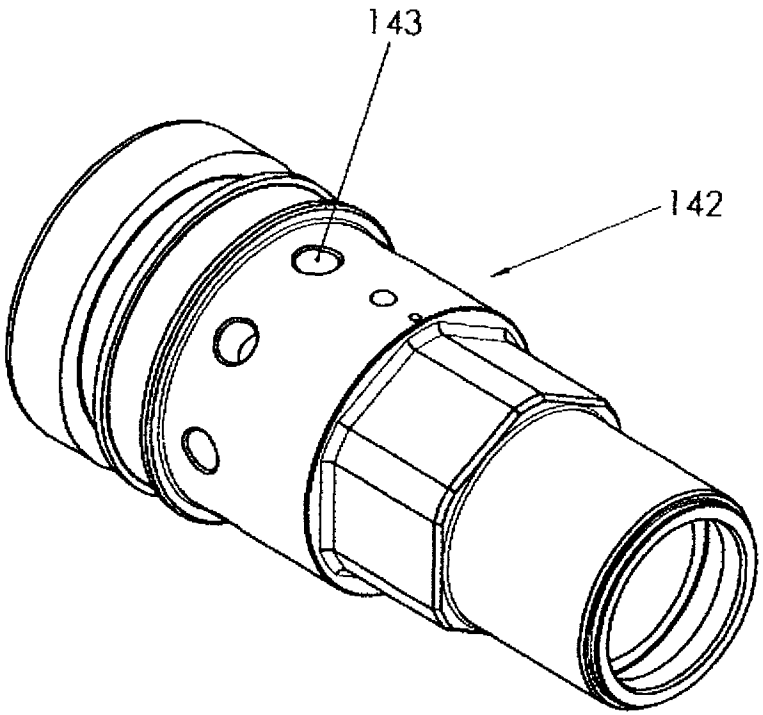
FIG. 14 a perspective view of a coupling sleeve of the guiding device of FIG. 5.

In the partial cross section of FIG. 10, it can be recognized that each of the spaces 141, which is formed between the base of each depression and the bottom side of the respective clamping strip 134, is connected to the pressure chamber via a respective channel 140. The volume of these spaces 141 changes depending on the respective extension of the clamping strips 134. Part of the drilling fluid is also conducted into the spaces 141 via the channels 140 (two channels 140 exist for each clamping strip). The relatively high pressure of the drilling fluid thus prevents drillings or other contaminations from migrating through the gaps formed between the clamping strips 134 in the edges of the depressions. In addition, manufacturing the clamping strips 134 and the depressions with a corresponding tolerance achieves that a small portion of the drilling fluid which flows through the space exits through the gap between the clamping strips 134 and the respective depression; this "leakage" of drilling fluid also prevents ingress of contaminations and further lubricates the movement of the clamping strips 134 in the depressions.

Integrated into the second housing section 113 (coupling housing) adjacent to the first section are coupling means which optionally establish a fixed rotative connection between the shaft 100 and the housing. The coupling means include a coupling sleeve 142 arranged between the housing and the shaft 100 which is shiftable between a first and a second position in direction of the longitudinal axis relative to the housing as well as to the shaft 100. On its circumference, the coupling sleeve 142 has a total of eight equidistant radial bores 143, each of which serves for receiving a (steel) ball 144, via which a fixed rotative connection can be established between the coupling sleeve 142 and the shaft 100. In the mounted state of the coupling sleeve 142, the balls 144 are pushed into a complex groove 146 on the outside of the shaft 100 (compare FIG. 13) via a spacer ring 145. This groove 146 is formed circumferentially and has a total of eight projections which are oriented in direction of the longitudinal axis and into which the balls 144 can be engaged by shifting the coupling sleeve 142 on the shaft 100. When engaged into the projections (first position—compare FIG. 11), the balls 144 prevent a rotation of the coupling sleeve 142 relative to the shaft 100. The engagement of the balls 144 is brought about by a prestressed cylindrical helical spring 147 which is supported by the front end of the coupling sleeve 142 via an adapter ring 148.

The movement of the coupling sleeve 142 from the first position to the second position (compare FIG. 12) is accomplished by the pressure of the drilling fluid in opposition to the force of the helical spring 147. For that, the drilling fluid is conducted via two transverse bores 149 from the central bore 150 in the shaft 100 into an annular space 151 which is formed between a section of the inside of the housing and the rear end surface of the coupling sleeve 142. In the second position of the coupling sleeve 142, the balls are located in the circumferential part of the groove 146 so that they do not prevent a relative rotation between the coupling sleeve 142 and the shaft 100.

The front section of the coupling sleeve 142 is moveably (in longitudinal direction) guided in an engagement sleeve 152 which is firmly connected to the housing via bolts 153. A section of the engagement sleeve 152 forms an internal hexagonal profile and a section of the coupling sleeve 142 forms an outer hexagonal profile (compare FIG. 14). The hexagonal profile sections of the coupling 142 and the engagement sleeve 152 engage each other in both operating positions of the coupling sleeve 142 so as to establish a fixed rotative connection between the coupling sleeve 142 and the housing (via the engagement sleeve 152). In the first operating position of the coupling sleeve 142, in which a fixed rotative connection is also established between the coupling sleeve 142 and the shaft 100 via the balls 144, a rotation of the shaft 100 which is connected to the drill rod is thus transferred to the housing.

Figure 15:
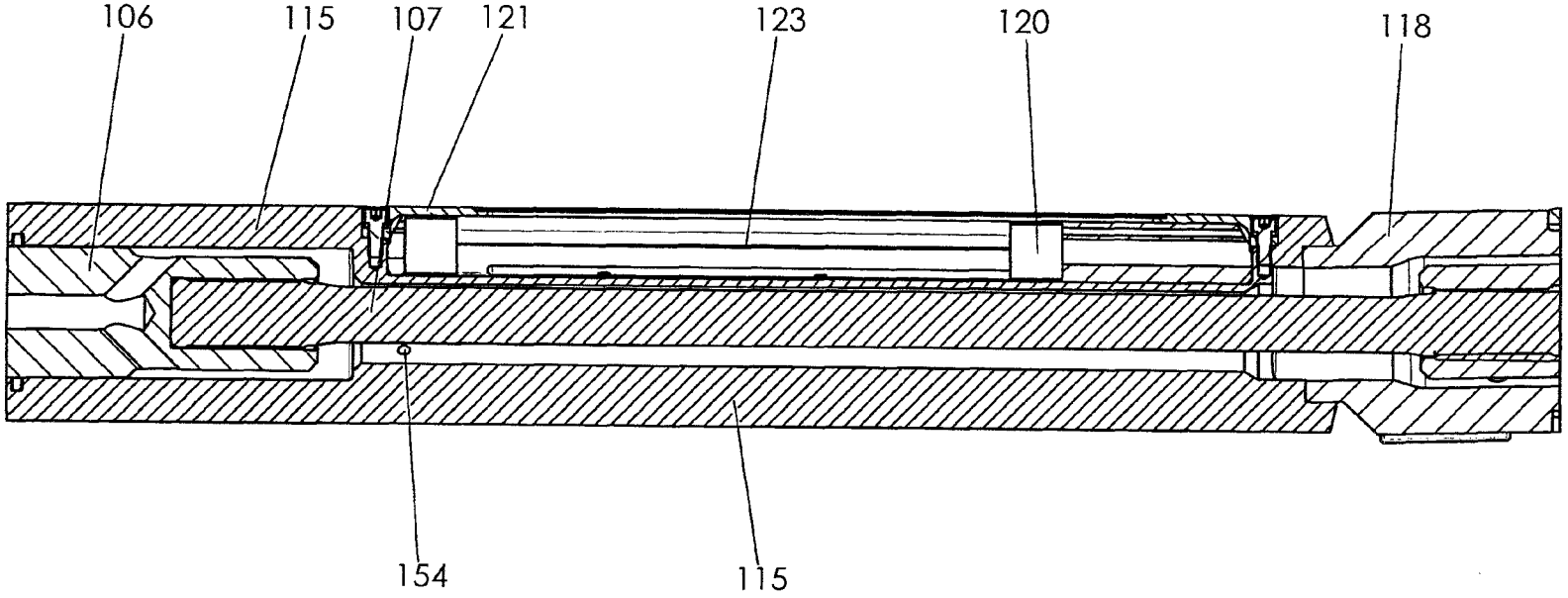
FIG. 15 a longitudinal section through a third section of the housing and the corresponding section of the shaft of the guiding device of FIG. 5.

The second housing section 113 is adjoined by a third housing section 115 (transmitter housing), in which a flexible section 107 of the shaft and a depression 120 for receiving a roll sensor 123 is integrated. FIG. 15 shows a longitudinal section through the respective section of the guiding device. The depression for the roll sensor 123 is configured sufficiently deep to accommodate the roll sensor 123 itself, as well as a lid 121, with which the depression 120 can be closed to the outside. A projecting lid which would lead to a constriction on the borehole can thus be avoided. Because the depression 120 for the roll sensor 123 extends deep into the housing, the flexible section 107 of the shaft 100, whose dimensions essentially depend on the required bending and torsion properties and thus cannot be randomly modified, is only separated from the roll sensor 123 by a thin wall.

The flexible section 107 of the shaft 100 has an external thread on each of its both ends via which it is bolted to the neighboring sections of the shaft 100, which sections are formed comparatively stiff. For reasons of durability, the diameter of these threaded ends has to be greater than the middle part of the flexible section. This requires a correspondingly great diameter of the longitudinal bore 154 provided in the housing for receiving the flexible section 107, to allow mounting of the flexible section 107. A centric arrangement of this longitudinal bore 154 would have led to an overlap with the depression 120 for the roll sensor 123 so that the longitudinal bore 154 is arranged slightly eccentric. The flexible section 107 of the shaft 100, when mounted, is arranged centrically within the housing however.

The connection between the third 115 and the fourth section 118 of the housing is configured angled, as can be seen from FIG. 15. As a result—as in the embodiment according to FIGS. 1 to 4—the desired steering ability of the drilling device can be achieved.

In the fifth section 119 of the housing (front bearing unit), which adjoins the fourth section 118 of the housing, a bearing is integrated for the shaft and configured such that it can support the at times significant bending torques which are transferred from the neighboring drill head 131 onto the shaft 100.

Figure 16:
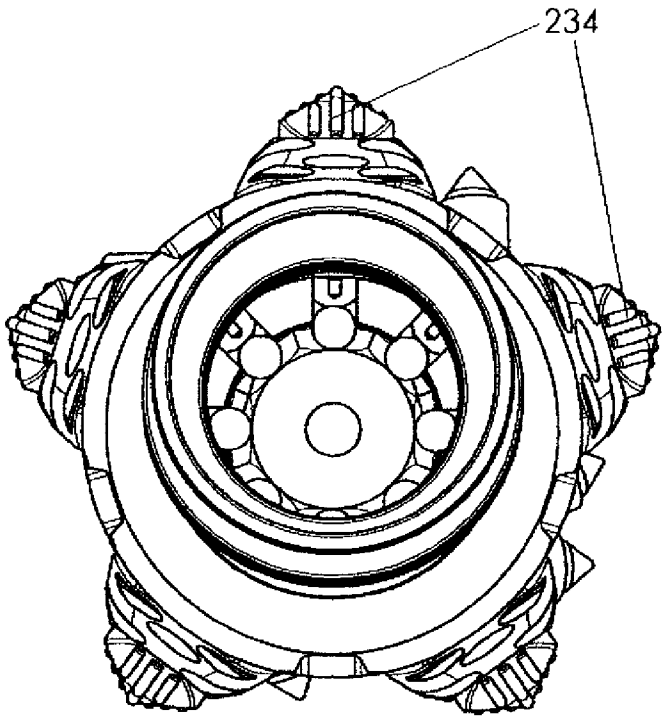
FIG. 16 a cross section through a guiding device according to the invention with asymmetric clamping strip.
Figure 17:
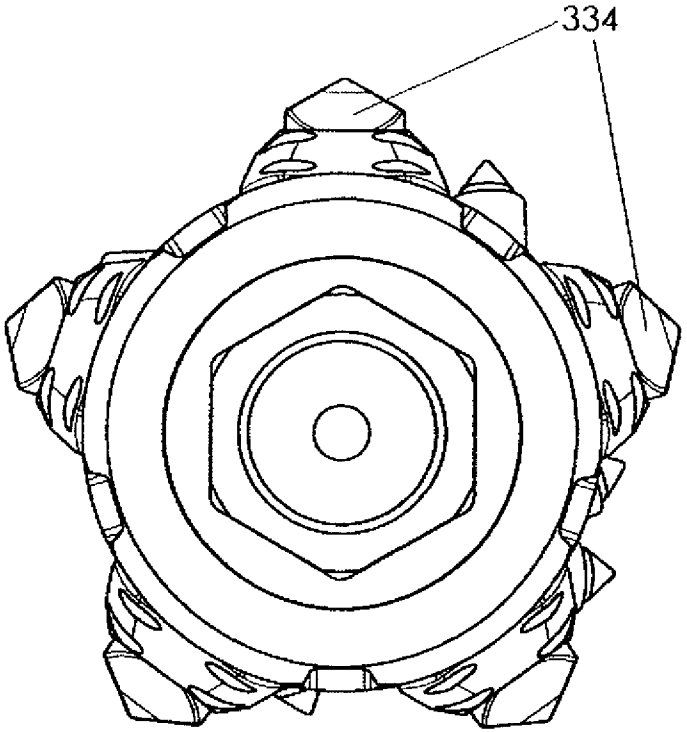
FIG. 17 a cross section through a guiding device according to the invention with asymmetric clamping strip.

FIGS. 16 and 17 show by way of example different cross sections for the clamping strips 234, 334, as used in the guiding device according to FIGS. 5 to 15. FIG. 16 shows (as also FIGS. 5 and 7) clamping strips 234 having an asymmetric cross section. Such a cross section allows for a particularly good support of the housing in the borehole wall, whereas in the opposite direction of rotation, the retraction of the clamping strips 234 is supported. The clamping strips 334 shown in FIG. 17 have a symmetric cross section to allow for easy retraction of the clamping strips in both rotational directions.

The invention claimed is:

1. A guiding device for a drilling device, comprising:

a housing comprising a plurality of housing sections and defining a deflection member for generating a lateral force, the deflection member including at least a first housing section and a second housing section of the plurality of housing sections fixedly attached to one another such that a longitudinal axis of the first housing section is not coaxial or parallel with a longitudinal axis of the second housing section;

a shaft rotatably supported within the housing, said shaft having first and second ends, said first end being constructed for connection to a drill rod of the drilling device, and said second end being constructed for connection to a drill head of the drilling device; and a coupling member for selectively enabling a fixed rotative connection of the shaft to the first and second housing sections while performing drilling operations in a generally linear direction.

2. The guiding device of claim 1, wherein the coupling member is operated hydraulically.

3. The guiding device of claim 2, wherein the coupling member is operated hydraulically using drill flushing.

4. The guiding device of claim 1, further comprising a spring element applying a force upon the coupling member to seek a starting position thereof, said coupling member being operated in opposition to the force applied by the spring element.

5. The guiding device of claim 1, wherein the shaft defines a longitudinal axis, and further comprising a coupling sleeve disposed between the shaft and the housing and shiftable in a direction of the longitudinal axis between a first position in which the coupling sleeve is connected in a fixed rotative manner to at least one member selected from the group consisting of the shaft and the housing, and a second position in which the coupling sleeve is rotatable relative to the member.

6. The guiding device of claim 1, further comprising at least one support element attached to the housing and extendable against a borehole wall for preventing rotation of the housing relative to the borehole.

7. The guiding device of claim 6, wherein the support element is extended hydraulically.

8. The guiding device of claim 7, wherein the support element is extended hydraulically using-drill flushing.

9. The guiding device of claim 6, further comprising a spring element applying a force upon the support element, said support element being operated in opposition to the force applied by the spring element.

10. The guiding device of claim 6, wherein the coupling member and the support element are controlled by a same medium, with the coupling member being controlled at a pressure which is lower than a pressure by which the support element is controlled.

11. The guiding device of claim 6, wherein the support element, at least in the extended state, is flushed underneath with a fluid.

12. The guiding device of claim 11, wherein the fluid is a drilling fluid.

13. The guiding device of claim 11, wherein the support element also when extended is arranged in a guide of the housing, and wherein a defined portion of the fluid is discharged through a gap formed between the support element and the guide.

14. The guiding device of claim 6, wherein the support element has an asymmetric cross section.

15. The guiding device of claim 1, wherein the first and second housing sections defining the deflection member form an arched section of the housing.

16. The guiding device of claim 15, wherein the shaft has at least one section which extends within the arched section, said section being configured flexible.

17. The guiding device of claim 16, wherein the at least one section of the shaft has a section which is arranged in an eccentric longitudinal bore of the housing.

18. The guiding device of claim 17, wherein a receptacle for a transmitter is integrated in a region of the eccentric longitudinal bore.

19. The guiding device of claim 1, further comprising cutting elements provided on the first end.

20. A drilling device, comprising:

a drill rod;

a drill head; and a guiding device comprising a plurality of housing sections and defining a deflection member for generating a lateral force, the deflection member including at least a first housing section and a second housing section of the plurality of housing sections fixedly attached to one another such that a longitudinal axis of the first housing section is not coaxial or parallel with a longitudinal axis of the second housing section;

a shaft rotatably supported within the guiding device of the drilling device, said shaft having first and second ends, said first end being constructed for connection to a drill rod of the drilling device, and said second end being constructed for connection to a drill head of the drilling device; and a coupling member for selectively enabling a fixed rotative connection of the shaft to the first and second housing sections while performing drilling operations in a generally linear direction.

* * * * *